US006598451B2

(12) United States Patent
Blue

(10) Patent No.: US 6,598,451 B2
(45) Date of Patent: Jul. 29, 2003

(54) INTERNALLY COOLED TOOL PACK

(75) Inventor: Rodney Blue, Huntington Beach, CA (US)

(73) Assignee: Sequa Can Machinery, Inc., East Rutherford, NJ (US)

( * ) Notice: Subject to any disclaimer, the term of this patent is extended or adjusted under 35 U.S.C. 154(b) by 24 days.

(21) Appl. No.: 10/003,652

(22) Filed: Nov. 2, 2001

(65) Prior Publication Data

US 2003/0084700 A1 May 8, 2003

(51) Int. Cl.[7] ..... B21D 22/28; B21D 37/16
(52) U.S. Cl. ..... 72/342.3; 72/349
(58) Field of Search ..... 72/342.3, 342.4, 72/349

(56) References Cited

U.S. PATENT DOCUMENTS

| | | | | | |
|---|---|---|---|---|---|
| 883,695 | A | * | 4/1908 | Canda | 72/342.3 |
| 3,112,828 | A | | 12/1963 | Zipf et al. | 207/10 |
| 3,559,447 | A | | 2/1971 | Bogart | 72/342.4 |
| 3,653,249 | A | | 4/1972 | Dunn | 72/349 |
| 3,808,865 | A | | 5/1974 | Wagner et al. | 72/269 |
| 3,943,740 | A | | 3/1976 | Bartenstein | 72/45 |
| 4,173,882 | A | | 11/1979 | Lee, Jr. | 72/349 |
| 4,300,375 | A | | 11/1981 | Maeder et al. | 72/45 |
| 4,442,692 | A | | 4/1984 | Lyu | 72/349 |
| 4,462,234 | A | | 7/1984 | Fiorentino et al. | 72/41 |
| 4,502,313 | A | * | 3/1985 | Phalin et al. | 72/349 |
| 4,829,802 | A | | 5/1989 | Baumann | 72/272 |
| 5,555,761 | A | | 9/1996 | Lavy | 72/349 |
| 6,047,587 | A | | 4/2000 | Naggert | 72/349 |
| 6,263,718 | B1 | * | 7/2001 | Buse et al. | 72/349 |

* cited by examiner

*Primary Examiner*—Lowell A. Larson
(74) *Attorney, Agent, or Firm*—Mitchell D. Bittman; Robert C. Faber

(57) ABSTRACT

A can forming tool pack includes internally cooled die modules. Each die module includes at least one die nib held in a case. Fluid cooling medium is supplied to multiple inlets provided circumferentially in each case, spaced symmetrically around the case. The cooling fluid is channeled from the inlets through clearances between an outer surface of the die nib and the case to cool the die nib. Outlets are spaced circumferentially around the case to return the cooling fluid to the medium supply.

13 Claims, 4 Drawing Sheets

INTERNALLY COOLED TOOL PACK

BACKGROUND OF THE INVENTION

1. Field of the Invention

The present invention relates generally to can manufacturing tool pack assemblies that have drawing and ironing dies for reforming a cup into a container body, and more specifically to such a tool pack assembly that is internally cooled.

2. Brief Description of the Related Art

Can forming dies are used to form the bodies of metal cans or containers. The description herein is particularly concerned with forming two piece metal containers. A shallow metal cup is driven into the dies by a punch to form the body of the can. The dies generally are provided in tool packs in which a series of progressively narrower die nibs are arranged to progressively draw and iron the metal cup into a container of the desired shape and thickness. An example of a conventional set of drawing and ironing dies in a tool pack is shown in U.S. Pat. No. 4,173,882 issued to Lee, Jr. on Nov. 13, 1979, the entire disclosure of which is incorporated herein by reference. Each die is included in a respective die module.

Die tool packs used in commercial can manufacturing conventionally use cooling fluids applied to the exterior of the die pack to maintain or reduce operational temperatures of the dies. In certain can forming applications, however, it is desirable to avoid the use of external cooling fluids. For example, external cooling fluids may contaminate the container surfaces, which requires costly and environmentally undesirable post-formation cleaning processes.

SUMMARY OF THE INVENTION

The present invention overcomes the disadvantages of the prior art, such as those noted above, by providing an internally cooled modular die tool pack assembly that does not require the use of cooling fluid applied to the exterior of the tool pack. Instead, the temperature of the tool pack is controlled by forcing a fluid, particularly a liquid, with desirable heat transfer properties around the die nibs through special die cavities and heat is transferred by conduction. The external temperature of each die nib can be monitored continuously at the respective die module, and the fluid medium temperature can be adjusted automatically to maintain acceptable die temperatures.

The fluid medium is supplied to the tool pack by a temperature control unit, and is delivered to the die modules by a series of pipes, fittings, and hoses. Fluid medium flows through porting in each module and its die where the fluid is directed circumferentially around the outer surface of the die nibs. Preferably, multiple porting in each die is circumferentially symmetrical, with alternating inlet and outlet ports to distribute the fluid medium uniformly around each die nib. The multiple fluid inlet and outlet design with symmetrical porting assures that all of the die nib temperatures remain substantially uniform, and also minimizes temperature gradients around the die. In a preferred embodiment, four inlet ports and four outlet ports are provided with inlet and outlet ports alternating at 45° apart. But the number and placements of ports can be altered to address specific temperature control requirements.

Other features and advantages of the present invention will become apparent from the following detailed description which refers to the accompanying drawings.

DETAILED DESCRIPTION OF AN EMBODIMENT OF THE INVENTION

Figure 1:
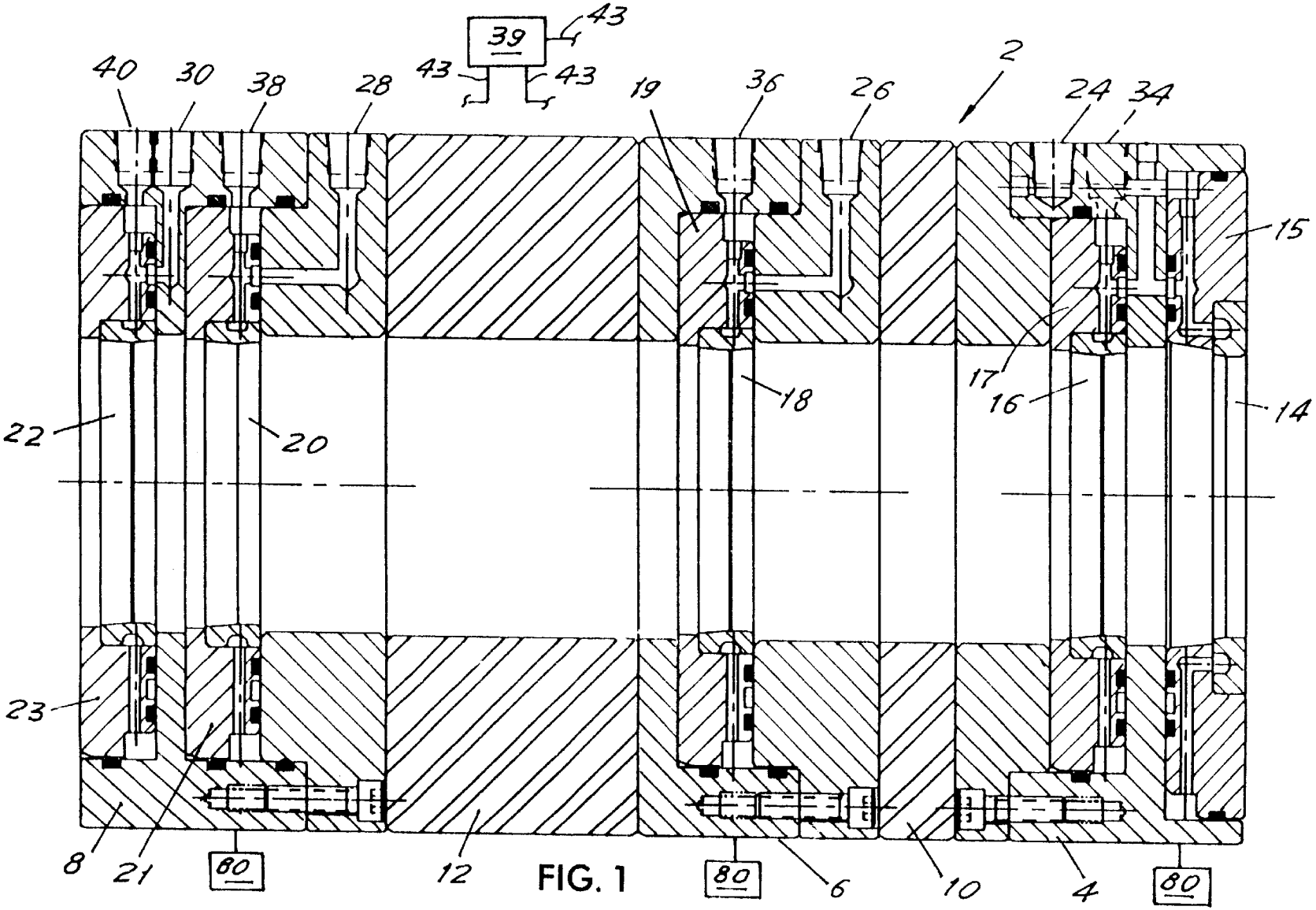
FIG. 1 is an axial cross section of an internally cooled modular tool pack assembly according to the present invention.

FIG. 1 shows an internally cooled modular die tool pack assembly 2 according to the present invention in an axial cross section. The assembly includes three annular die modules 4, 6, and 8 in sequence, with adjacent modules separated by spacers 10 and 12. The first die module 4 includes an annular redraw die nib 14 followed by a first annular ironing die nib 16. The next die module 6 includes a second annular ironing die nib 18. The final die module 8 includes annular die nibs 20 and 22. Die nibs 14, 16, 18, 20, and 22 are held in die cases 15, 17, 19, 21, and 23, respectively.

Referring also to FIGS. 2–5, each of the die modules 4, 6, and 8 has at least one inlet port and at least one outlet port for cooling medium. When multiple inlet and outlet ports are utilized, the ports preferably are arranged alternately and symmetrically around each die module.

Figure 2:
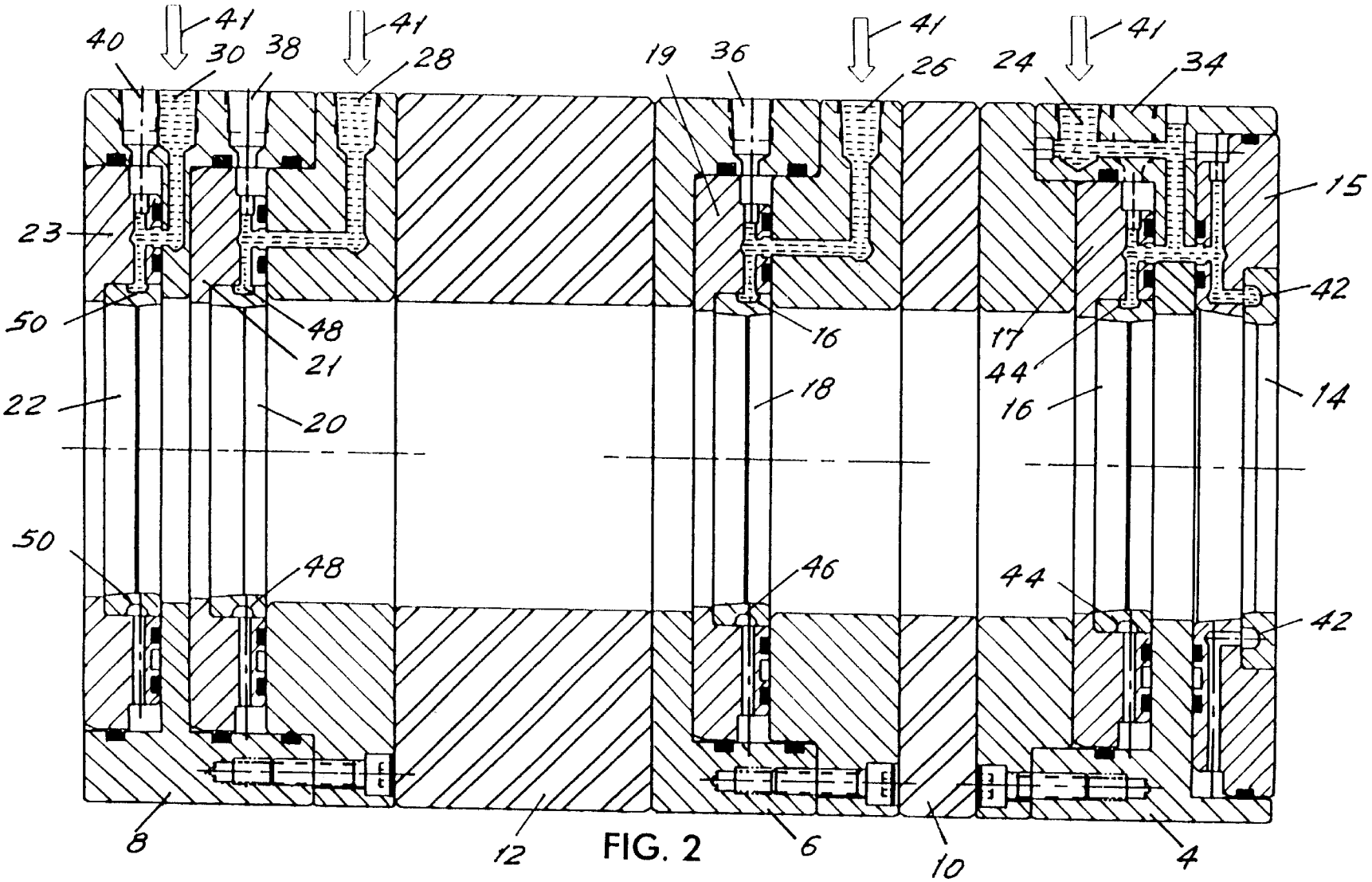
FIG. 2 is the axial cross section of FIG. 1 showing fluid cooling medium pathways flowing into the assembly.
Figure 3:
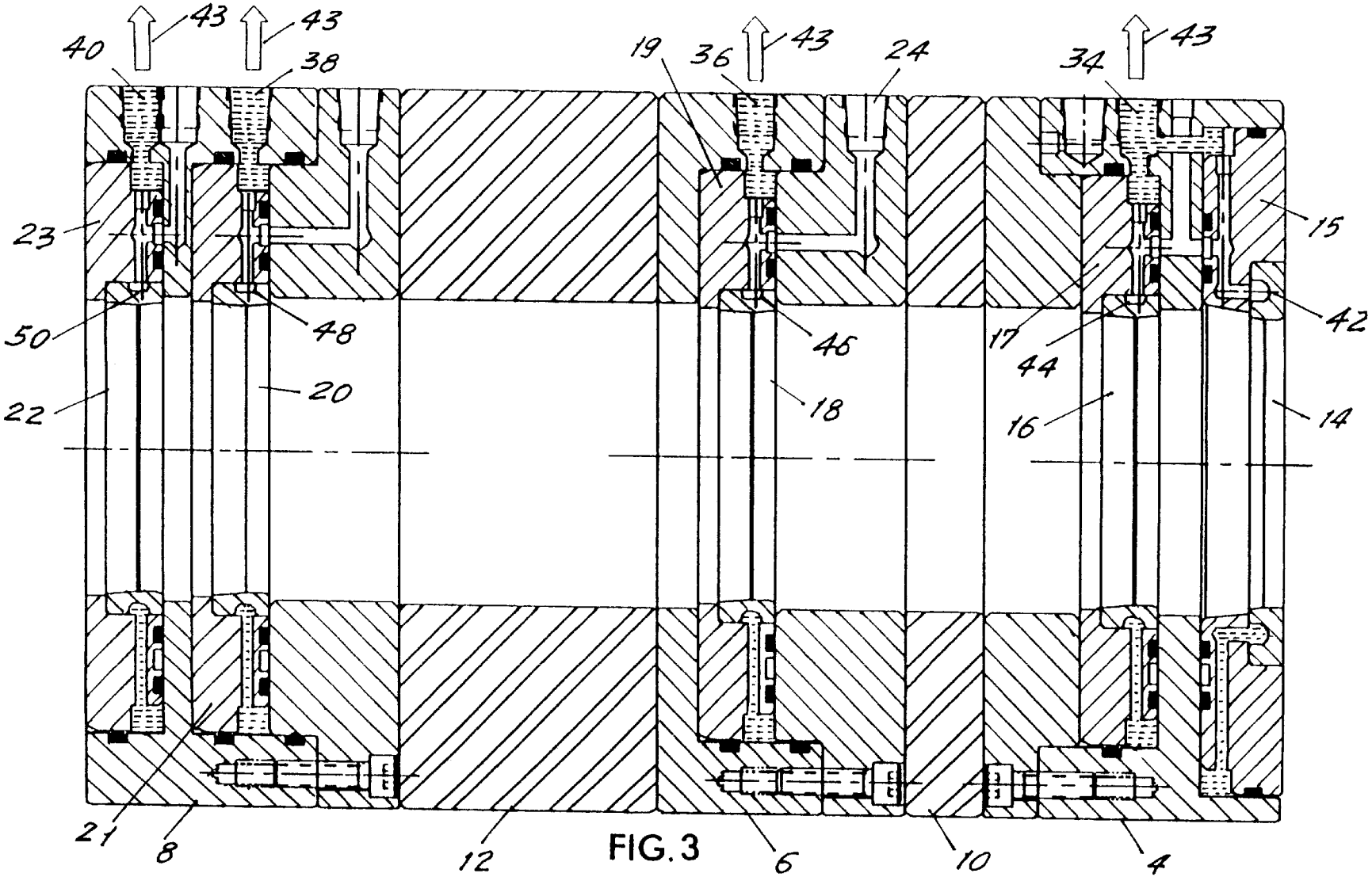
FIG. 3 is the axial cross section of FIG. 1 showing fluid cooling medium pathways flowing out of the assembly.

Referring more specifically to FIG. 2, the first die module 4 is provided with an inlet port 24, the second module 6 is provided with inlet port 26, and the third module 8 has inlet ports 28 and 30. Similarly, as shown in FIG. 3, die module 4 is provided with an outlet port 34, module 6 is provided with outlet port 36, and module 8 has outlet ports 38 and 40, from which cooling medium exits the tool pack assembly.

Fluid cooling medium provided by a conventional temperature control unit 39 flows through conduits 43 (FIG. 1) into the die modules through the inlet ports as shown by the directional arrows 41 of FIG. 2. Passages machined into each die module and through the cases direct the cooling medium to channels 42, 44, 46, 48, and 50 formed in outer walls of die nibs 14, 16, 18, 20, and 22 respectively.

The temperature control unit 39 may control both the rate of flow to each conduit 43 and inlet port at 41 and the respective temperature at each conduit and inlet port independently of the other conduits and inlet ports to accommodate and control the temperatures at the various die modules, since each module may be subject to a different respective heat load. After circulating partially circumferentially around each die, the cooling medium flows out of the die modules as shown by the directional arrows 43 of FIG. 3.

Thus, cooling medium flows through the channels in direct contact with a radially outer surface of each of the die nibs, drawing off heat that is generated in the die nibs during can drawing and ironing. Generally, the cooling medium passing around the die nibs absorbs heat and cools the die nib to maintain a desired temperature in each die nib. The fluid may also be heated to warm the die nibs, for example at machine startup. This may be desirable to minimize thermal expansion effects and improve the drawing, ironing and can stripping processes.

Figure 5:
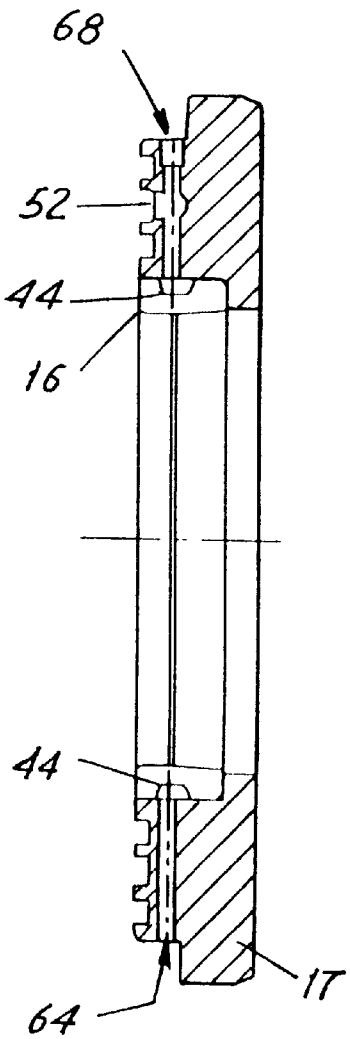
FIG. 5 is a cut away view of the drawing and ironing die taken along the line V—V of FIG. 4.
Figure 4:
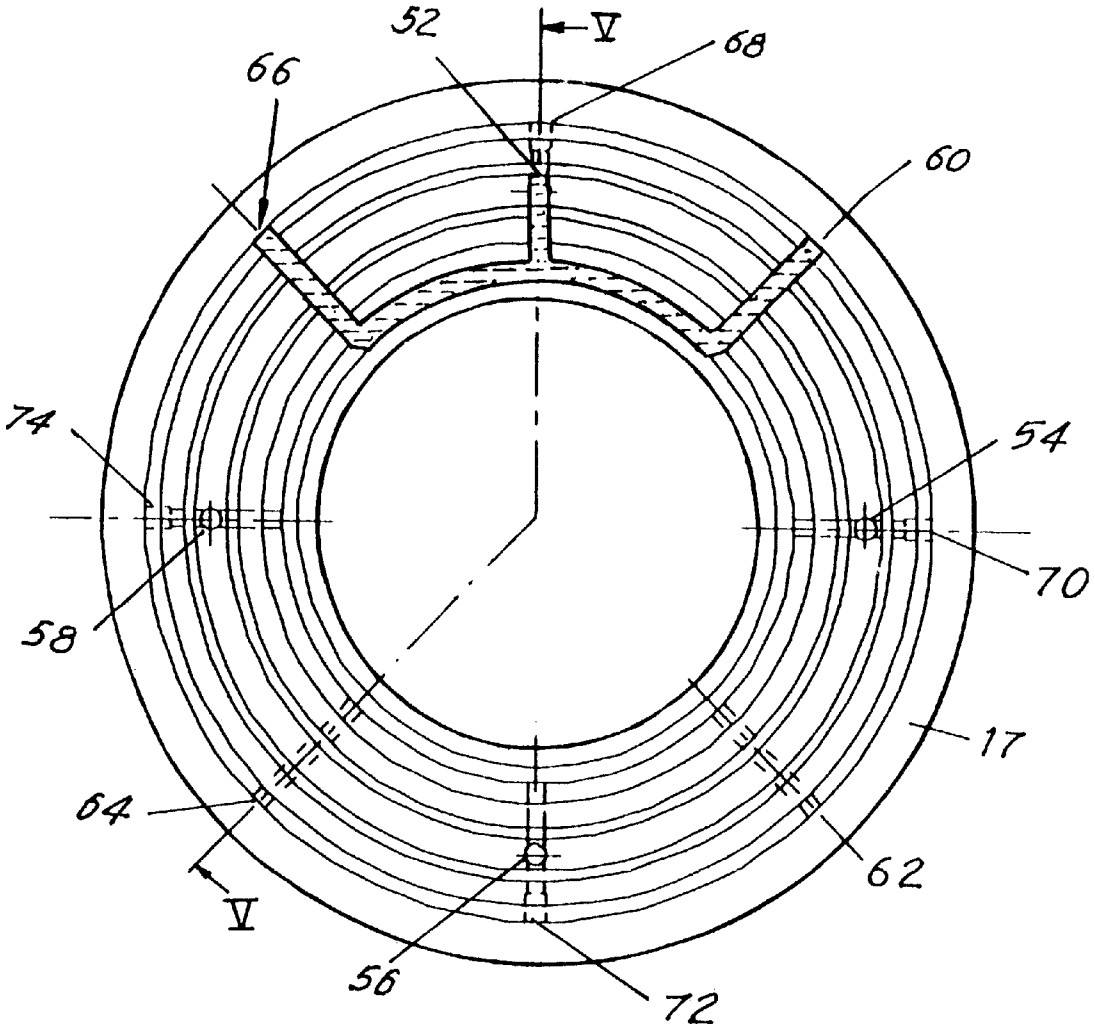
FIG. 4 is a transverse cross section of a drawing and ironing die showing cooling fluid pathways in the die according to the present invention.

Referring to FIGS. 4 and 5, die nib 16 and die case 17 are shown to illustrate the symmetrically spaced inlets and outlets for providing cooling media to die nib 16. Cooling medium enters case inlets 52, 54, 56, and 58, flows radially in through case 17, and circumferentially along channel 44 formed around one quarter of the outer circumference of die 17. Cooling medium exits the die module through outlets 60, 62, 64, and 66. Plugs 68, 70, 72, and 74 seal off the machined outer ends of inlets cooling medium, and temperature adjustments can be made as necessary.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A die module to draw and iron an object, the module comprising:

a die nib having an inner surface defining an object receiving orifice having a periphery, the inner surface of the die nib being configured to receive the object via the object receiving orifice to one of draw and iron the object, the die nib further including a plurality of fluid paths fully enclosed within the die nib and arranged adjacent to respective portions of the periphery of the object receiving orifice; and a case surrounding the die nib, the case including a plurality of inlets symmetrically spaced around the case, the inlets being configured to receive a fluid cooling medium and to supply the cooling medium to respective ones of the fluid paths of the die nib, the case further including a plurality of outlets, at least one of the outlets being assigned to each of the fluid paths, the outlets being configured to permit the fluid cooling medium to flow out of the case from the fluid paths of the die nib;

wherein the fluid paths are configured to prevent the cooling medium from contacting the inner surface of of the die nib, and the symmetrically spaced inlets permit the fluid cooling medium to evenly cool the die nib.

2. The die module according to claim 1, wherein the periphery of the orifice is cylindrically shaped, and the plurality of fluid paths are arranged around the cylindrically shaped periphery of the object receiving orifice.

3. The die module according to claim 2, wherein one of the outlets is assigned to each fluid path, and each of the fluid paths is arranged adjacent to respective portions of the cylindrically shaped periphery of the object receiving orifice.

4. The die module according to claim 1, wherein the plurality of outlets are arranged symmetrically around the case.

5. A can forming die assembly, comprising:

a plurality of the die modules arranged in a linearly to enable a punch to pass through the respective die modules, each of the modules including a die nib having an inner surface defining an object receiving orifice having a periphery, the inner surface of the die nib being configured to receive a object via the object receiving orifice to one of draw and iron the object, the die nib further including a plurality of fluid paths fully enclosed within the die nib and arranged adjacent to respective portions of the periphery of the object receiving orifice; and a case surrounding the die nib, the case including a plurality of inlets symmetrically spaced around the case, the inlets being configured to receive a fluid cooling medium and to supply the cooling medium to respective ones of the fluid paths of the die nib, the case further including a plurality of outlets, at least one of the outlets being assigned to each of the fluid paths, the outlets being configured to permit the fluid cooling medium to flow out of the case from the fluid paths of the die nib;

wherein the fluid paths are configured to prevent the cooling medium from contacting the inner surface of the die nib, and the symmetrically spaced inlets permit the fluid cooling medium to evenly cool the die nib.

6. The can forming die assembly according to claim 5, wherein the periphery of the orifice is cylindrically shaped, and the plurality of fluid paths are arranged around the cylindrically shaped periphery of the object receiving orifice.

7. The can forming die assembly according to claim 6, wherein one of the outlets is assigned to each fluid path, and each of the fluid paths is arranged adjacent to respective portions of the cylindrically shaped periphery of the object receiving orifice.

8. The can forming die assembly according to claim 5, wherein the plurality of outlets are arranged symmetrically around the case.

9. A die module arrangement to draw and iron an object, the module comprising:

a fluid warming medium a die nib having an inner surface defining an object receiving orifice having a periphery, the inner surface of the die nib being configured to receive the object via the object receiving orifice to one of draw and iron the object, the die nib further including a plurality of fluid paths fully enclosed within the die nib and arranged adjacent to the periphery of the object receiving orifice; and a case surrounding the die nib, the case including a plurality of inlets symmetrically spaced around the case, the inlets being configured to receive a fluid warming medium and to supply the warming medium to respective ones of the fluid paths of the die nib, the case further including a plurality of outlets, at least one of the outlets being assigned to each of the fluid paths, the outlets being configured to permit the fluid warming medium to flow out of the case from the fluid paths of the die nib;

wherein the fluid paths are configured to prevent the warming medium from contacting the inner surface of the die nib, and the symmetrically spaced inlets permit the fluid warming medium to evenly warm the die nib.

10. The die module according to claim 9, wherein the periphery of the orifice is cylindrically shaped, and the fluid path is arranged around the cylindrically shaped periphery of the object receiving orifice.

11. The die module according to claim 10, wherein the at least one fluid path includes a plurality of fluid paths, and the at least one outlet includes a plurality of outlets, one of the outlets being assigned to each fluid path, and each of the fluid paths being arranged adjacent to respective portions of the cylindrically shaped periphery of the object receiving orifice.

12. The die module according to claim 9, wherein the plurality of outlets are arranged symmetrically around the case.

13. The die module according to claim 9, wherein the at least one inlet includes a plurality of inlets arranged symmetrically around the case.

* * * * *